United States Patent [19]

Chickneas et al.

[11] Patent Number: 4,813,912

[45] Date of Patent: Mar. 21, 1989

[54] SECURED PRINTER FOR A VALUE PRINTING SYSTEM

[75] Inventors: Arthur A. Chickneas, West Redding; Paul C. Talmadge, Ansonia, both of Conn.

[73] Assignee: Pitney Bowes Inc., Stamford, Conn.

[21] Appl. No.: 902,904

[22] Filed: Sep. 2, 1986

[51] Int. Cl.[4] ..... G06F 15/20

[52] U.S. Cl. ..... 364/464.02; 235/375; 364/519

[58] Field of Search ..... 346/75; 364/464, 466, 364/705, 519; 400/126; 380/23, 28, 29; 235/375

[56] References Cited

U.S. PATENT DOCUMENTS

| | | | |
|---|---|---|---|
| 4,097,923 | 6/1978 | Eckert, Jr. et al. | 364/900 |
| 4,168,533 | 9/1979 | Schwartz | 364/705 X |
| 4,253,158 | 2/1981 | McFiggans | 364/900 |
| 4,360,905 | 11/1982 | Hackett | 340/554 X |
| 4,422,148 | 12/1983 | Soderberg et al. | 364/464 |
| 4,458,109 | 7/1984 | Mueller-Scholer | 380/30 |
| 4,481,604 | 11/1984 | Gilham et al. | 364/900 |
| 4,494,114 | 12/1985 | Kaish | 364/900 X |
| 4,506,253 | 3/1985 | Mande et al. | 340/510 X |
| 4,649,266 | 3/1987 | Eckert | 235/494 X |

*Primary Examiner*—Parshotam S. Lall

*Assistant Examiner*—Edward R. Cosimano

*Attorney, Agent, or Firm*—Donald P. Walker; David E. Pitchenik; Melvin J. Scolnick

[57] ABSTRACT

A system is disclosed for securing a device from invasive and noninvasive tampering, one such device being a printer assembly for use in a value printing system, such as a postal mailing system. The system is comprised of a Decryption Microcomputer operable for decrypting the input data to be printed in accordance with a valid cipher key, the encrypted data and key being provided by another device, such as a postal meter. The cipher key is stored within a Tamper Latch readably coupled to the Microcomputer for providing the key to the Microcomputer. In addition, the Tamper Latch has a wire of small cross-sectional area connected thereto such that the presence of the wire is operable for defining a portion of the cipher key. To provide further security from tampering the Microcomputer, Latch and wire are embedded within a potting material. An attempt to remove the potting material in order to gain access to the components embedded therein will cause a brakage of the wire, thereby invalidating the cipher key and rendering the Microcomputer inoperable for decrypting the data to be printed.

26 Claims, 5 Drawing Sheets

SECURED PRINTER FOR A VALUE PRINTING SYSTEM

BAKCGROUND OF THE INVENTION

A. Field of the Invention

This invention relates generally to tamper prevention devices and, more particularly, to a tamper prevention device and method of using same for securing a printhead utilized for the printing of indicia in a value printing system, such as a postal mailing machine.

B. Prior Art

A postage meter typically includes a printer to print postal information on a mail piece. Postage meters of this type are described in U.S. Pat. No. 4,097,923 issued to Alton B. Eckert, Jr., Howel A. Jones, Jr. and Frank T. Check, Jr., entitled "A Remote Postage Meter Charging System Using an Advanced Micro-Computerized Postage Meter" issued on June 27, 1978.

Another example of a meter that utilizes a printer is described in U.S. Pat. No. 4,422,148 issued to John H. Soderberg and Alton B. Eckert, Jr. and Robert B. McFiggans entitled "Electronic Postage Meter Having Plural Computing Systems" issued on Dec. 20, 1983.

The postage meters above described all contain printers that are an integral part of the meter itself. Although these meters as above described serve their intended purpose in an exemplary fashion it is always important to develop new and improved postage metering devices to decrease cost and improve speed and efficiency.

As is well known, in a typical system the postage meter will contain the printing apparatus to facilitate applying postage to a mail piece or the like. The printing apparatus located within the postage meter adds to the cost and the complexity of the meter.

Typically, in an electronic postal mailing system it is important that the postal funds within the meter are secure. What is meant by the funds being secure is that when the printer prints postage indicia on a mail piece, the accounting register within the postage meter always should reflect that the printing has occurred. In typical postal mailing systems, since the meter and the printer are integral units, both are interlocked in such a manner as to insure that the printing of a postage indicia cannot occur without accounting. Postal authorities generally require the accounting information to be stored within the postage meter and to be held there in a secure manner, thus any improved postal mailing system should include security features to prevent unauthorized and unaccounted for changes in the amounts of postal funds held in the meter. Postal authorities also require that meters be put in service and removed from service in strict compliance with their requirements for registration and periodic (say, for example, every 6 months) inspection. This enables the Post Office to keep records on the usage of a meter and detect fraud. Thus, there are also administrative costs associated with the record keeping, inspection and servicing of meters.

There is a continuing need for less expensive and higher speed postage meters. As before-mentioned, typically a postage meter has associated with it different peripherals that add to the cost thereof. It is important to develop postage meters that can be adaptable to postal mailing systems which are less expensive and more efficient, but will also be able to maintain the high level of security associated with the above-mentioned postage meters. It is also important that any new postal mailing system developed be one in which security can be maintained in a manner in keeping with the previously mentioned mailing systems.

A problem is created, however, when the postage meter and the printer are no longer integrally contained within a secure enclosure, in that the printer must be protected from being purposely or inadvertently activated for printing postage indicia without an accounting of that printing being made by the meter. For example, if the printer were disconnected from the postal mailing system and subsequently commanded to print postage indicia, the aforesaid accounting registers within the meter would not be updated to reflect the values of postage so printed. Thus, such tampering with the postal mailing system would result in the fraudulent printing of postage.

One system for securing postage printing transactions which are performed by a printing and an accounting station which are interconnected through an insecure communications link is disclosed in U.S. Pat. No. 4,253,158, titled "System For Securing Postage Printing Transactions" and assigned to the assignee of the present invention. In the aforementioned U.S. patent, each time the postage meter is tripped, a number generator at the printing station is activated to generate a number signal which is encrypted to provide an unpredictable result. The number signal is also transmitted to the accouting station. At the accounting station the postage to be printed is accounted for and the number signal is encrypted to provide a reply signal. The reply signal is transmitted to the printing station where a comparator compares it with the encryption result generated at the printing station. An equality of the encryption result and the reply signal indicate that the postage to be printed has been accounted for and the printer is activated to print postage.

While well suited for securing the operation of a postage meter printing station having an insecure communications link, such a system does not readily provide protection for the printing station against an invasive tampering with the station. Such invasive tampering may include physical entry of the station, or entry the printing element, or head, itself, in an attempt to directly activate the printing element to fraudulently print postage indicia.

SUMMARY OF THE INVENTION

A system and method for securing a device from invasive and noninvasive tampering is disclosed, one such device being a printer assembly for use in a value printing system, such as a postal mailing system. In an illustrative embodiment, a secure printhead module for use with a printer of an electronic postal mailing system is disclosed. The printhead module is secured against both invasive and noninvasive tampering by providing within a continuity sensor means operable to define a portion of a decryption key and, also, a microcomputer which decrypts encrypted postage indicia data. Coupled to the microcomputer is a nonvolatile Tamper Latch for storing a cipher key used to decrypt the indicia data. One bit of the cipher key is provided by an easily borken conductor having a small cross-sectional area, the conductor being randomly disposed within a potting material which encases the Tamper Latch in order to detect if the potting material has been removed or disturbed. Also coupled to the microcomputer and activated thereby is the printing device, which in the illustrated embodiment is an ink jet printer device suitable or printing dot matrix type data.

In operation, the printhead module receives encrypted data representative of the dot matrix pattern required to produce the desired postal indica and, in addition, the cipher key required to decrypt the data. This encrypted data is provided by an electronic postage meter which comprises an accounting unit. The accounting unit is comprised of a processing unit, in this embodiment a microcomputer, a non-volatile memory (NVM) and a NVM data protection unit connected to the microcomputer. In addition, there is also connected to the microcomputer an indicia memory, wherein a representation of the fixed pattern of the postage indicia is stored in digital form.

The postage meter provides a capability of generating encrypted data representative of a validation number and the fixed pattern of the indica for printing on a document. This generated validation number provides a method for detection of unaccounted printing and supplies the postal authorities with information on the meter accounting registers. The high speed printer of this embodiment would be located within the mailing machine or some other host which would also be a part of the mailing system.

The host or mailing machine of this embodiment comprises principally a second microcomputer, and the high speed printer. The printer comprises a third microcomputer for decrypting the data representative of the indicia to be printed and, additionally, for controlling the ink jet printhead mechanism. In one embodiment, the meter is able to communicate over a high speed, secure data bus with the mailing machine or host to perform all the accounting functions, to accept funds, reset to zero for removal from service and any other actions that electronic postal mailing systems generally perform. The meter is also able to communicate with the host to provide an encrypted digital representation of the fixed pattern of the postage indicia itself. In addition, it is advantageous in this meter to use security techniques which are used in existing meters, such as a mechanically secure enclosure and electromagnetic shielding, isolating power supply and isolating communication links.

The electronic postage meter, as before-mentioned, does not print postage but supplies encrypted data which will represent the validation number for the postage amount that it accounts for and, in addition, the encrypted dot matrix representation of the fixed portion of the postage indicia. In this embodiment the validation number is to be printed along with a dollar amount, the meter serial number and the date of issue. The validation number is typically printed in a system approved format that would be appropriate for automatic detection if required. This encrypted validation number is used to detect illegal printing of a dollar amount that has not been accounted for.

In this illustrative embodiment the mailing machine's processing unit would receive a dollar amount from a keyboard or the like and would send the information to the processing unit of the meter. The meter would thereafter generate an encrypted validation number using a key and plain text supplied by the processing unit of the meter. The plan text would be the postage information and meter accounting registers of the meter. It should be recognized that other information such as date, origin of the document, destination, etc., can also be use depending on the need and desires of user. The key would be internally stored within the NVM.

The meter would then send the validation number along with the meter serial number, the encrypted representation of the fixed pattern of the postage indicia and the key required to decrypt the pattern to the processing unit of the mailing machine or host. The processing unit within the host thereafter sends the postage indicia, decryption key, meter serial number, dollar amount and validation number to a printer. The printer, in turn, by the use of a decryption algorithm executed by the microcomputer contained within the printhead module, decrypts the pattern to print the postage indicia, date, meter serial number, dollar amount and validation number on a mailpiece or document.

Thus, in this illustrative embodiment a first microcomputer within the meter would be in communication with a second microcomputer within a mailing machine or some other type of host unit which in turn would be in a communication with a third microcomputer in the printer. In this system, the postage meter would supply encrypted data which represents an encrypted validation number and the fixed portion of the postage indicia to the mailing machine. After receiving the appropriate signal from the postage meter, the mailing machine would signal its printer to decrypt the data to print the postage indicia including the desired postage amount.

The postage meter contains no printer thereby making it less complex and less expensive. The encryption scheme utilized to protect the validity of the postage indicia can be any of a variety of schemes known to those skilled in the art including, for example, those that have been used typically to protect the accounting information located within the meter.

Therefore, this system provides for a less expensive and simpler postage meter which could be adapted to a wide variety of mailing machines. This system also allows for a postage meter which is completely separated from the printing function in which only an electrical signal representing the fixed pattern of the meter serial number and the postage indicia, and validation number is supplied to a peripheral device, i.e., a mailing machine with a printer. This system also makes it much easier for the Post Office or other agency to detect fraud by making it possible to keep more accurate and up-to-date on usage of each meter. This system additionally provides for securing the printer from external tampering, without the requirements of the prior art systems of containing the printer and meter together within a secured postal machine of unitary construction.

In accordance with a method of the invention the device to be protected from tampering is provided with a first portion of a valid decryption key information and a second valid portion which is provided by a continuity sensor means which is operable to provide the second valid portion only when the sensor means detects continuity. The device is further provided with encrypted information which is decrypted by the device in accordance with the first and second valid decryption key information portions, the device thereafter utilizing the decrypted information to provide a desired output.

BRIEF DESCRIPTION OF THE DRAWINGS

The above-mentioned and other features of the invention will become better understood with reference to the following detailed descriptions when taken in conjunction with the accompanying drawing, wherein like reference numerals designate similar elements in the various figures, and in which.

DETAILED DESCRIPTION

The invention is disclosed in the context of a postal mailing machine having an ink jet printer mechanism, however, other types of printer mechanisms may have the invention applied thereto with equal success. Such other types of mechanisms include impact dot matrix mechanisms. In addition, the invention is well suited for securing against tampering other types of devices responsive to input data for activating the device to produce a certain output, such as in an electronic combination lock mechanism.

Cross reference is hereby made to two related patent applications which are incorporated herein by reference in their entireties; an application entitled "Secure Vault Having Electronic Indicia For a Value Printing System" by Paul T. Talmadge, Ser. No. 902,903, filed concurrently herewith, and an application entitled "Secure Metering Device Storage Vault For A Value Printing System" by Paul Talmadge, Ser. No. 902,844, filed concurrently herewith.

Figure 1:
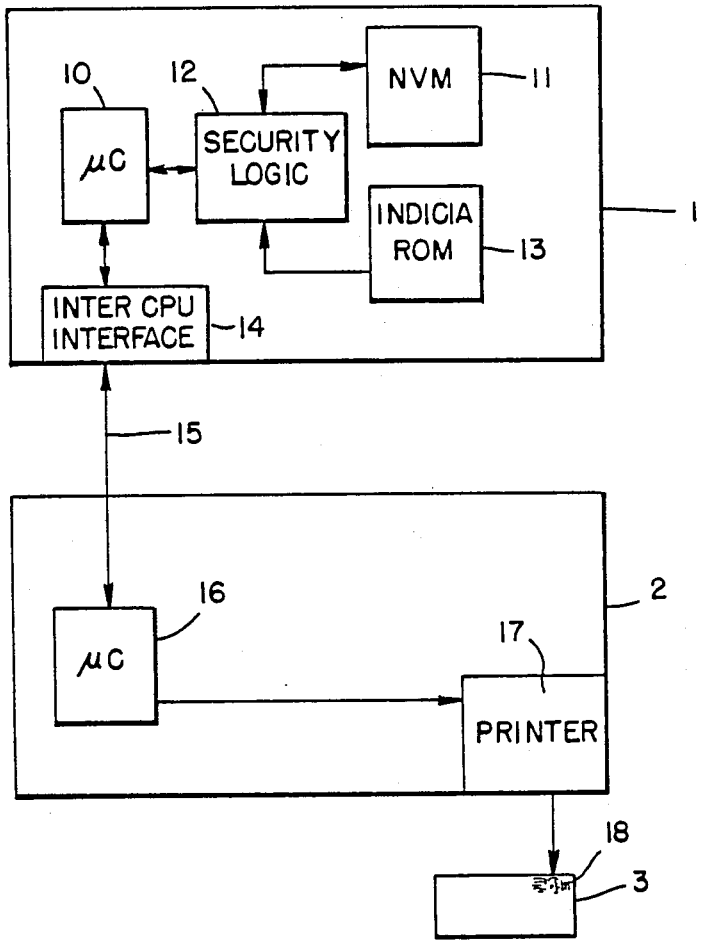
FIG. 1 is a block diagram of an electronic postal mailing system having a secure printer assembly in accordance with one embodiment of the invention.

FIG. 1 shows in block diagram form a mailing system embodying the printhead assembly of the invention. The mailing system is comprised of the postal meter 1, also referred to herein as an electronic vault or as a vault, which is in communication with the host 2. The host 2, typically, is a mailing machine but can also be a variety of other devices which could communicate with the meter. The host 2, in turn, prints a postage indicia 18 including a postage amount along with other information on a document 3 by means of a printer 17.

The meter 1 comprises a processing unit or microcomputer 10 which is coupled to a non-volatile memory (NVM) 11 through security logic 12. The processor unit, for example, can be a microprocessor, a microcontroller, microcomputer, or other intelligent device which provides processing capability, hereinafter referred to as either a processor, microcomputer or microprocessor. The meter 1 preferably additionally includes an inter CPU interface 14 which is conventionally constructed and arranged for interfacing the meter 1 with the host 2 via a communication link 15. The meter 1 of this embodiment does not have a printer associated therewith and instead, provides electronic signals which represent, typically, the validation number and the fixed pattern of the postage indicia to the host 2.

As can be also seen, the host 2 comprises a second processing unit or microcomputer 16 and may include the printer 17. The printer may also be a separate unit. The microcomputer 16 provides intelligence to allow for the communication back and forth to microcomputer 10 of the meter and to the printer 17 to initiate printing when the proper information is given thereto.

Typically, a keyboard or the like (not shown) sends the information representing the postage amount to microcomputer 16. Thereafter, the microcomputer 16 sends a signal to microcomputer 10 consisting of the postage amount to obtain a validation number for printing.

The microcomputer 10 after receiving a signal from microcomputer 16 will compute anmd encrypted validation number based in part on a key stored within the NVM 11. Access to the NVM 11 is gained through security logic 12 which provides for ensuring the integrity of the accouting, encryption, and other data stored within NVM 11. The validation number, by way of example, may be computed by combining the serial number of the postage meter and a secret code stored within the NVM 11.

The validation number will thereafter be transmitted to the microcomputer 16 of the host 2 along with an encrypted representation of the fixed pattern of the postal indicia 18 stored in an indicia ROM13 to initiate the printing process. The printer after decrypting the fixed pattern, in turn will print on the document 3 the information communicated from the microcomputer 16. Thus, the meter provides to the host 2 the fixed pattern of the postage indicia, the meter serial number, and the validation number to be printed on document 3. The host 2 provides the postage amount. In this embodiment, either the host 2 or the meter 1 can provide the city, state and date information.

Figure 2:
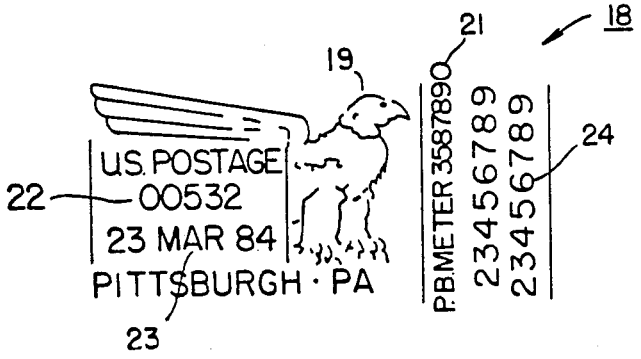
FIG. 2 shows the postage indicia printed by the postal mailing system of FIG. 1.

Referring now to FIG. 2, the indicia 18 may be seen to have a graphical, fixed pattern 19, a dollar amount 22, a date and a city of origin 23 and a meter serial number 21. In addition, the indicia 18 will include a validation number 24. Pattern 19 is said to be fixed inasmuch as it is not necessary to determine it for each indicia printed, unlike the amount 22. As may be appreciated, although the pattern 19 is shown in FIG. 2 to have the form of a graphical representation of an eagle, a variety of predetermined, distinctive patterns could b used, depending on the particular application of a value printing system embodying the invention. For example, abstract or encoded patterns, such as a bar code, could be used.

Figure 3:
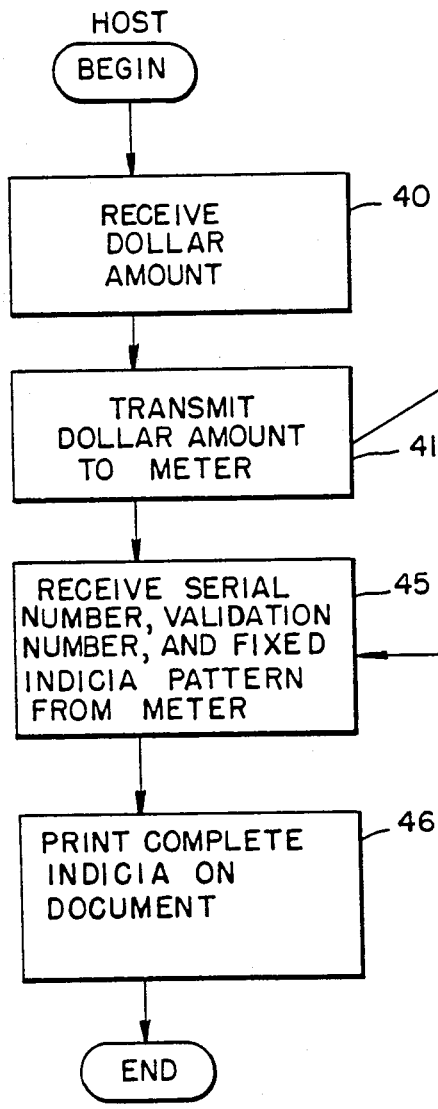
FIG. 3 is a flow chart of the operation of the host of the postal mailing system of FIG. 1.
Figure 4:
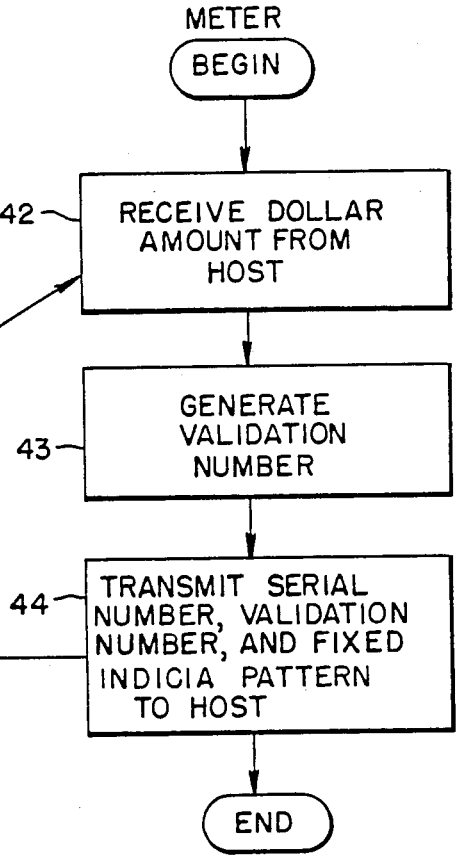
FIG. 4 is a flow chart of the operation of the meter of the postal mailing system of FIG. 1.

FIGS. 3 and 4 are flow charts describing the operation of the postal mailing system. Initially the host 2 (FIG. 1) will receive a required postage dollar amount from a source, whether that be an operator or some other source, indicated by box 40. Thereafter, the dollar amount is transmitted to the meter 1 (FIG. 1), box 41. Referring to FIG. 4, the meter will then receive that dollar amount from the host 2, box 42, and will thereafter generate a validation number, box 43. After generating the validation number, the meter 1 will thereafter transmit the meter serial number, the validation number, which includes postal information, and the fixed portion of the indicia back to the host 2, box 44. Referring back to FIG. 3, the host 2 will then receive the meter serial number, validation number, and fixed portion of the indicia from the meter, box 45. Thereafter the printer 17 (FIG. 1) will print on the document 3 the fixed portion of the postage indicia 19, the dollar amount 22, the date 23, the meter serial number 21, and the validation number 24 received from the meter 1, box 46.

Inasmuch as a stated purpose of the postage mailing machine is to provide for the high speed printing of postage indicia on documents, the transfer of data between meter 1 and host 2 must be accomplished in a high speed and efficient manner. This requirement may be made even more evident by considering the representation of the fixed pattern 19 of the postage indicia 18 stored in the indicia ROM 13 of FIG. 1.

Typically, a postage indicia represented in a format suitable for printing by a dot matrix type of printing device has a standard size of one inch by two inches and is comprised of 240 columns each having 120 dots, each dot possibly having one of three levels of intensity. The total number of bits required to represent such a dot matrix type of indicia may be 68,400, or approximately 10,800 bytes. As may be appreciated, if the postage indicia is supplied to the host 2 for each document printed, a considerable amount of data must be rapidly transferred between meter 1 and host 2, especially considering that in a high speed postage metering system three or more documents may be so printed every second.

In addition to the requirement for a high speed data communications bus linking the meter 1 and the host 2, such a high speed dot matrix printing requirement necessitates the use of a suitable high speed printer. Such a printer must, in addition to having a capability for high speed operation, be capable of providing a print quality and other print characteristics which make it suitable for printing postage and other valuable indicia. One such suitable printer is an ink jet printer, wherein droplets of ink are electrostatically deflected at high speeds by electronically controlled deflection plates, as is well known in the art.

Figure 5:
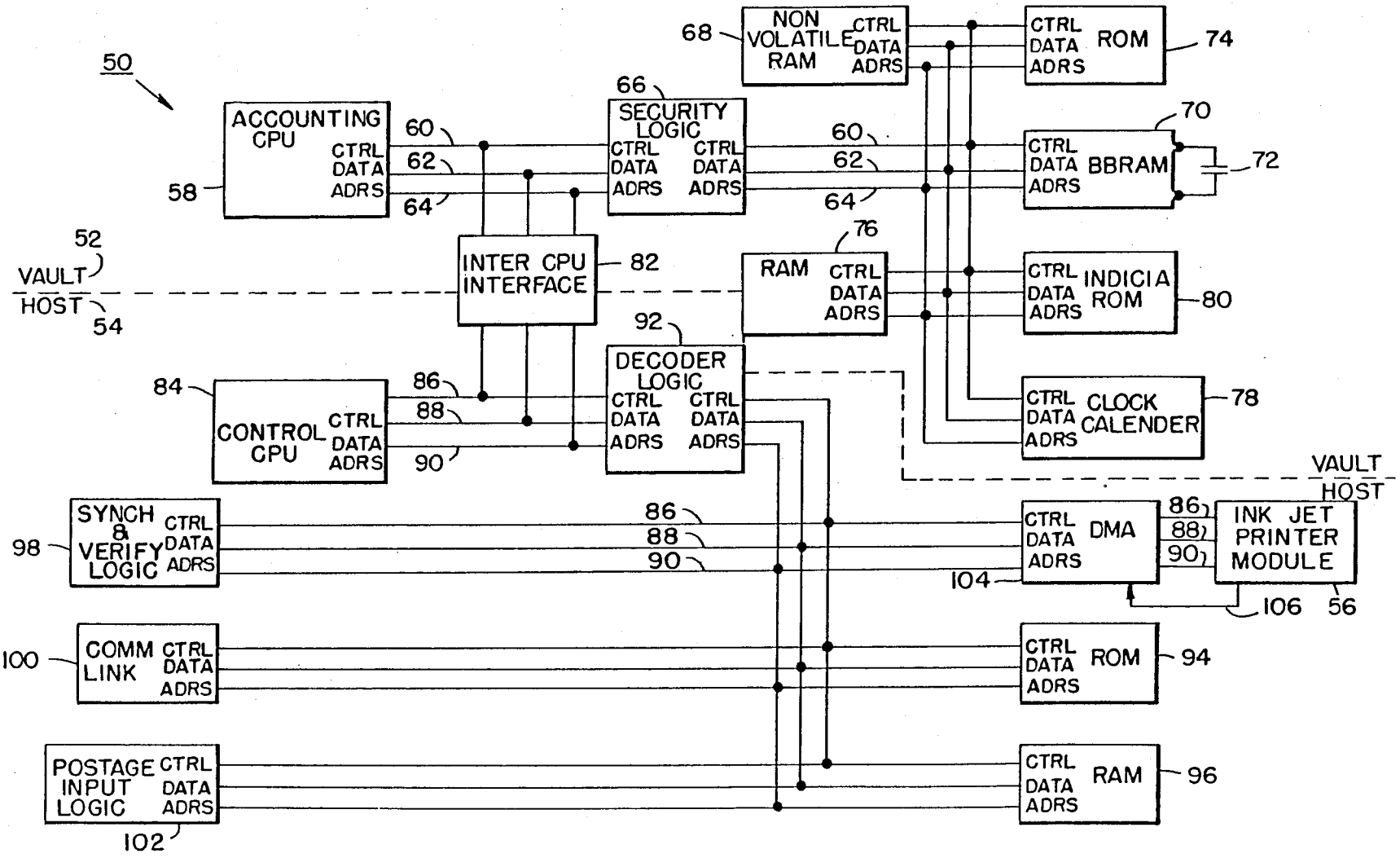
FIG. 5 is a block diagram of one embodiment of the postal mailing system.

Referring now to FIG. 5 there is shown in block diagram form on embodiment of a high speed, modularized postage metering system 50. System 50, as shown, is comprises of three main modules, those being a secure metering module, or Vault 52, a print control module, of Host 54, and an Inkjet Printer Module 56 having an embodiment of the invention.

Vault 52 is further comprised of an Accounting CPU 58, which may be a microprocessor such as the Z-80 manufactured by the Zilog Corporation and other manufacturers.

As is well known, such a microprocessor has a bus structure characterized by a control bus 60, a data bus 62, and an address bus 64. The purpose of the busses is to control, identify, and transfer program instructions and data to and from memory and input/output (I/O) devices connected to the busses.

Connected to the busses 60, 62 and 64 is a Security Logic 66 circuit which monitors the addresses generated by CPU 58 in order to control the memory accesses made to two random access memories (RAM) wherein the meter accounting data is stored; those memories being nonvolatile RAM (NOVRAM) 68 and battery backed-up RAM (BBRAM) 70. Coupled to BBRAM 70 is a battery 72 having a voltage suitable for maintaining the data stored within BBRAM when the power is removed from system 50. As is well known in the art, a nonvolatile RAM such as NOVRAM 68 has the characteristic of maintaining the data stored within after the removal of power from the RAM.

A security logic circuit that could be utilized for the Security Logic 66 is disclosed in U.S. patent application Ser. No. 710,802 now abandoned and the continuation application Ser. No. 122,580 thereof filed Nov. 16, 1987 and entitled "Postage Meter with a Non-Volatile Memory Security Circuit" filed on Mar. 2, 1985, and assigned to the assigned of the subject application. The circuit disclosed in this application provides means for limiting the amount of time that the accounting memories may be continuously enabled and also provides other protective mechanisms so that the valuable accounting information stored therein cannot be inadvertently modified or destroyed.

The use of two separate memories for holding the accounting information is described in U.S. Pat. No. 4,481,604, wherein such memory redundancy is utilized to minimize the possibility of error conditions occurring in an electronic postage meter.

Also connected to CPU 58 by the busses 60, 62 and 64 are a program storage read only memory (ROM) 74 wherein the operating instructions and constants required by CPU 58 are stored. An RAM 76 is also provided to store temporary data and other information required by CPU 58 during the execution of its normal operating program. As is well known, such a device is commonly referred to as a "scratchpad" RAM.

Also connected to CPU 58 is a clock/calendar device 78 which provides for maintaining the current time and date information. Such information is required, typically, for printing as a part of the postage indicia. In this embodiment of the invention Vault 52 will provide the current time and date to Host 54 for printing. As may be appreciated, the clock/calendar device 78 could alternatively be contained within Host 54, thereby reducing the amount of data which must be provided by Vault 52 to Host 54 for each postage indicia printed. In a still further embodiment of the invention, both the Vault 52 and Host 54 would each contain such a clock/calendar device. Appropriate software routines in each of the Vault 52 and Host 54 could then be utilized, before the printing of a postage indicia, to verify that the time and date in each module are in agreement, thereby providing a still further degree of security.

In addition to the above described devices connected to the busses 60, 62 and 64 there is provided an indicia ROM 80. ROM 80 has permanently stored within a representation, or copy, of the fixed pattern 19 (shown in FIG. 2) of the postage indicia 18. As was described above, fixed pattern 19 is stored as a series of data bytes representative of the dot matrix pattern required to print fixed pattern 19. The bytes of data representative of this fixed pattern 19 may be provided to Host 54 by Vault 52 in an encrypted form for each postage indicia printed. Thus a high degree of security is achieved in the use of the system 50 in that the graphical format of the postage indicia cannot be purposely or inadvertently reproduced by Host 54 unless the Vault 52 is attached thereto and, additionally, unless the required communication between the two modules is accomplished in a predefined and specific manner. Thus, the accounting by Vault 52 of each postage indicia printed is assured.

In order to provide an efficient and high speed means for transferring the possibly large amount of data between Vault 52 and Host 54, a high speed data communications means is required. This communications means is provided by an Inter-CPU Interface 82 which couples CPU 58 to a control CPU 84 within Host 54.

The function of CPU 84 is to control the printing of postage indicia on a document (not shown in FIG. 5) by Printer Module 56 in response to document position and system timing inputs provided by a mailing machine (not shown) coupled to Host 54. Such mailing machines typically are comprised of document feeders and conveyors and function to collate documents for insertion within an envelope, the envelope then being printed with the correct postage, having a predetermined, given value. In a high speed mailing machine there may be three or more envelopes per second which require the printing of postage thereon. Such high speed operation necessitates that CPU 84 operate in a "real time" environment and, hence, be of a suitable type for this operation. One suitable type of microprocessor for such a demanding application is a member of the 68000 family of microprocessors, such microprocessors being manufactured by the Motorola Corporation and other manufacturers.

Connected to CPU 84 are a plurality of busses, namely a control bus 86, a data bus 88 and an address bus 90 for coupling CPU 84 to a plurality of memory and I/O devices.

A decoder logic 92 block operates to decode the address 90 and control 86 busses, in a well known manner, in order to generate one of a plurality of device select signals (not shown) for activating a proper one of the devices connected to the busses 86, 88 and 90 of CPU 84.

An instruction ROM 94 contains the operating instructions and constants required by CPU 84 to carry out its function of controlling the printing of postage indicia. Scratchpad RAM 96 is utilized by CPU 84 to contain variable and temporary data required for operation.

In order to provide CPU 84 with a means to communicate with the mailing machine and other external devices a Synch and Verify Logic 98 block and a Postage Input Logic 102 block are provided. The purpose of the Sync and Verify Logic 98 is to provide CPU 84 with inputs from the mailing machine (not shown), such inputs being representative of timing and position information relating to the documents being processed by the mailing machine. In addition, Synch and Verify Logic 98 provides for outputting the required control signals from CPU 84 to the mailing machine (not shown).

Postage Input Logic 102 block provides for inputting data representative of the dollar amount of postage required by each document. This input may be provided by, for example, an operator keyboard or the output of a document weighing machine. The amount of postage required by each document is provided by CPU 84 to CPU 58, as has been previously described, in order that Vault 52 may make an accounting of the amount.

In addition to the above described logic block, a Comm Link 100, or communications logic block, is provided for interfacing CPU 84 to other devices by way of a standard communications link, such as RS-232-C or IEEE-488 or some other general purpose serial or parallel communications channel. As examples of devices that may be connected to Comm Link 100 are a printer for printing system status and accounting information or a modem for allowing telephone communications with a central computer, such as a postal facility accounting computer.

In order to provide CPU 84 with the ability to perform one of its basic functions, that is the printing of postage indicia, a high speed direct memory access (DMA) 104 device is provided to couple the busses 86, 88 and 90 to the Inkjet Printer Module 56. In operation, CPU 84 may temporarily store within RAM 96 the encrypted data bytes representative of the fixed pattern of the postage indicia provided by Vault 52 and, additionally, date representative of the variable portions such as the postage amount 22 and date 23 (as shown in FIG. 2). The complete indicia would thereby be represented as a plurality of encrypted data bytes descriptive of, for example, the dot matrix pattern required to form the indicia 18. DMA 104, after activation by CPU 84, functions to automatically provide MODULE 56 with indicia dot matrix data from RAM 96 for printing on a document.

As is well known, a DMA device such as DMA 104 functions typically to transfer data from one memory location to another location, without the intervention of the system processing means. For example, in the system 50 of FIG. 5 DMA 104 transfers encrypted indicia data from RAM 96 to Printer Module 56 for printing. This is accomplished by DMA 104 temporarily assuming control of busses 86, 88 and 90 in order to address RAM 96, read the data stored therein, and activate Printer Module 56 to accept the data.

After transferring the data DMA 104 relinquishes control of busses 86, 88 and 90 to CPU 84 in order that CPU 84 may continue to execute a control program.

Normally, Printer Module 56 would activate a DMA Service Request 106 signal in order to initiate a data transfer cycle, DMA 104 responding to the activation of Request 106 by assuming control of busses 86, 88 and 90, as has been previously described.

As may be appreciated, if DMA 104 is not active, that is if DMA 104 has not assumed control of busses 86, 88 and 90, then CPU 84 may utilize these same busses for the communication of data to and from Printer Module 56.

Figure 6:
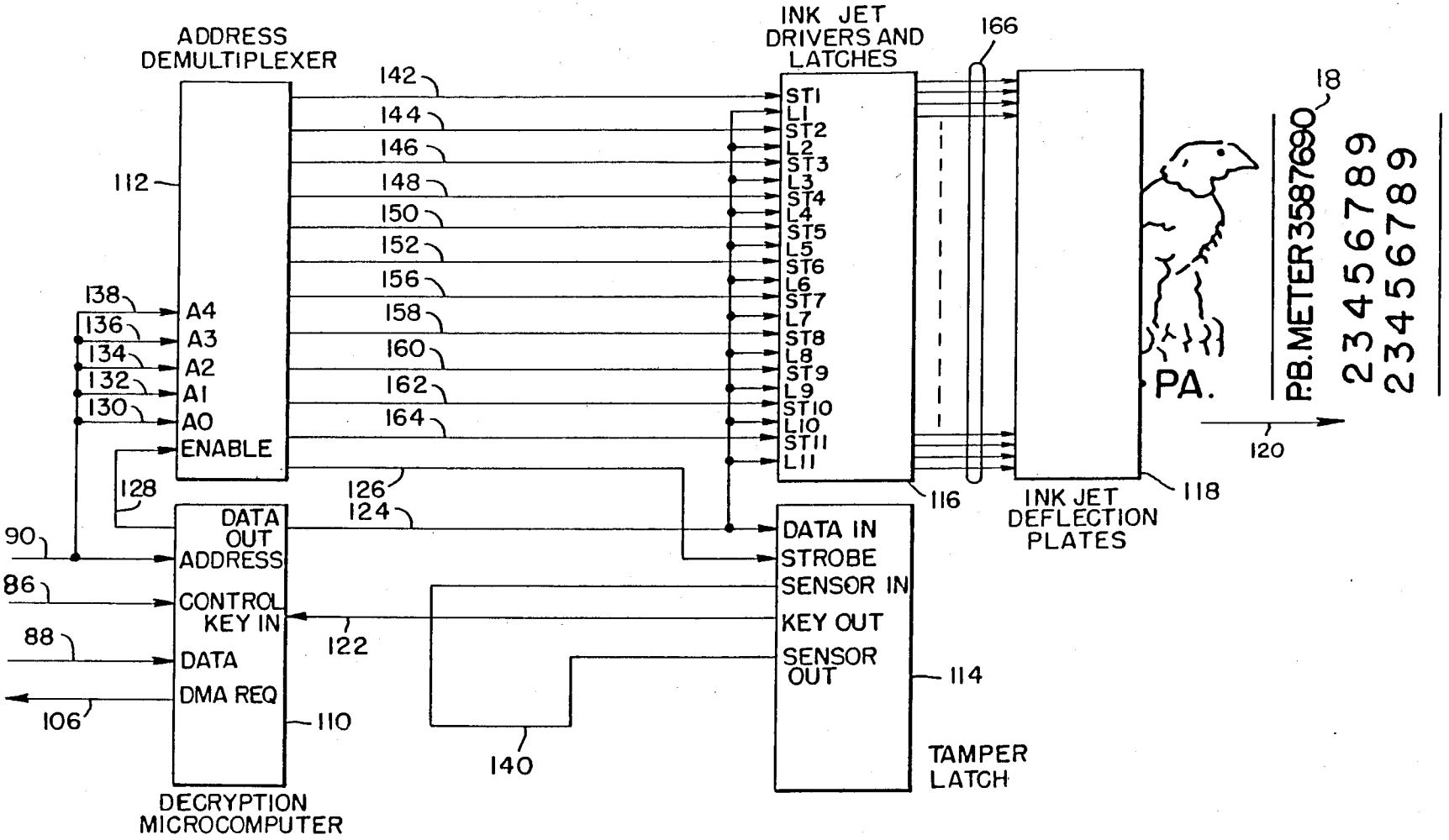
FIG. 6 is a block diagram of the Ink Jet Printer Module of FIG. 5.

Referring now to FIG. 6 there is shown, in accordance with the invention, the secure Inkjet Printer Module 56. As has been previously mentioned, the function of Module 56 is to print on a document a postage indicia 18. In order that each such indicia 18 printed be accounted for by Vault 52 it is necessary to provide a means to insure that Module 56 is protected, or secured, against unauthorized operation, or tampering. Such an antitampering means must be effective against both invasive and noninvasive tampering.

In general, invasive tampering involves a physical assault upon the Module 56 itself, such an assault being made to gain access to the components contained within with the intent of, perhaps, directly activating them in order to fraudulently print postage indicia. Noninvasive tampering, by contrast, involves seaking to externally stimulate Module 56 in order to fraudulently print postage indicia. One possible method to achieve this goal would involve monitoring or recording the stream of data which is inputted to Module 56 during the printing of an indicia. The recorded data could then be subsequently reinputted to Module 56 in an attempt to cause it to reprint the indicia one or more times. In the case of both invasive and noninvasive tampering, the Vault 52 may be unaware that Module 56 is printing indicia, therefore no accounting, as required by law, would be made of the value of the indicia so printed.

As shown in FIG. 6, Module 56 is comprised of a Decryption Microcomputer (CPU) 110, an Address Demultiplexer (DEMUX) 112, a Tamper Latch 114 and the inket printer mechanism comprised of Ink Jet Drivers and Latches 116 and Ink Jet Deflection Plates 118.

In operation, Module 56 functions to print a postal indicia 18 on a document (not shown), the document being transported past the Plates 118 in the direction indicated by the arrow 120. In order to accomplish this function, a stream of data is supplied to CPU 110 via the Control 86, Data 88 and Address 90 busses of the Host 54, as shown in FIG. 5. The data so supplied is provided, typically, by DMA 104 in response to the activation of the DMA Request (DMA REQ) 106 signal by CPU 110, CPU 110 activating DMA REQ 106 at the proper times to maintain a constant stream of data to allow the printing of the indicia 18 upon the moving document (not shown).

In accordance with the invention, the data so provided is first encrypted by Vault 52. Such encryption could typically conform to the Data Encryption Standard (DES) FIPS PUB 46, in which postal information, namely, the dollar amount, the date, the ascending register amount, and the piece counter content can be combined with a key. Encrypting data converts the data to an unintelligible form called cipher. Decrypting cipher converts the data back to its original form. The algorithm described in the aforementioned standard specifies both enciphering and deciphering operations which are based on a binary number called a key, or key data.

The key data is typically the serial number of the postage meter, which is printed on the document, and a secret constant. The key and postal information is thereafter combined with the pattern data stored in ROM 80, in accordance with the aforesaid DES algorithim, to output an encrypted form of indicia pattern data. This encrypted indicia pattern data is subsequently transferred by Vault 52 to RAM 96 via Interface 82 and CPU 84. Thereafter, the encrypted data is provided to Module 56 by DMA 104, as has been described.

It is known that data can be decrypted from cipher only by using exactly the same key used to encrypt it. Thus, it is clear that CPU 110 within Module 56 must utilize the same key to decrypt the pattern data as that used by CPU 58 of Vault 52 to encrypt the data.

Therefore, it is necessary for CPU 58 to provide the key to CPU 110 in order for CPU 110 to decrypt the indicia pattern data. In this embodiment of the invention the key is made available to CPU 110 by the Vault 52 CPU 58 causing the key to be written within Tamper Latch 114, the key thereafter being provided by Latch 114 on demand to CPU 110 via a KEY BUS 122.

Tamper Latch 114 may be a nonvolatile memory or some other suitable device for maintaing the data stored within when the power is removed from the system 50. Or, alternatively, the key may be stored within an internal memory location of the CPU 110 instead of within an external memory device, such as Tamper Latch 114. If the key is so stored internally, the CPU 110 may be provided with a battery to maintain CPU 110 active when the system power is removed. A CPU constructed with CMOS technology having a low power requirement is particularly well suited for such an application.

In operation, the key data would be stored within Latch 114 by CPU 110 driving the data onto a Local Data Bus (LDB) 124 and by CPU 110 causing DEMUX 112 to generate a Latch Strobe 126 signal. DEMUX 112 is caused to generate Strobe 126 by CPU 110 activating a DEMUX Enable 128 signal. When Enable 128 is so activated DEMUX 112 is enabled to decode a portion of Address Bus 90, shown in FIG. 6 as the five least significant bits (LSB's), namely A0 through A4, signals 130 through 138, respectively. During the interval that the key data is to be stored within Latch 114 by CPU 110, CPU 84 will first provide the key data, as obtained from Vault 52 via Interface 82, to CPU 110. CPU 84 will also place A0 through A4, signals 130 through 138, respectively, in a proper state such that DEMUX 112 may decode those signals to generate the Strobe 126. The operation of such a demultiplexer is well known in the art.

In addition to generating the Strobe 126, DEMUX 112 is also operable for generating a plurality of Printer Data Strobes 142 through 164. Each such Strobe 142 through 164 is connected to a strobe input (ST1-ST11) of Latches 116 and functions to activate a corresponding data latch (L1 through L11) within Latches 116 to store decrypted indicia data provided by CPU 110 on LDB 124. The data so stored is subsequently outputted by Latches 116 by means of a plurality of drivers (not shown) within Latches 116, the driver outputs driving lines 166 for activating Ink Jet Deflection Plates 118 to print the indicia 18. The operation of such an ink jet deflection mechanism is well known in the art.

In order to provide the proper data to a proper one of the latches within Latches 116, DEMUX 112 decodes the lower five bits of the address bus 90 and generates the corresponding strobe output when enabled by Enable 128, as has been previously described. When generating the Strobes 142 through 164 the address bus 90 is typically being driven by DMA 104, the state of address bus 90 therefore corresponding to a location within RAM 96 wherein the encrypted data is stored One aspect of the invention is that Vault 52 may compute a unique key for each postage indicia printed, thereby defeating an attempt to noninvasively tamper with module 56. As may be appreciated, if the encrypted data representative of indicia 18 were recorded and subsequently reinputted to Module 56, CPU 110 would be incapable of decrypting the data unless it were provided with the corresponding key for the particular data stream so recorded.

To further defeat an attempt to tamper with Module 56, Vault 52 is also provided with the capability to read back a key previously stored within Latch 114, the key being read back via CPU 110, CPU 84 and Interface 82. Thus Vault 52 may verify that the key presently stored within Latch 114 is the key previously stored, and not a key fraudulently stored in order to decrypt a prerecorded data stream.

Module 56 has additional security features, beyond those described above, which render it immune to invasive as well as noninvasive tampering.

Figure 7:
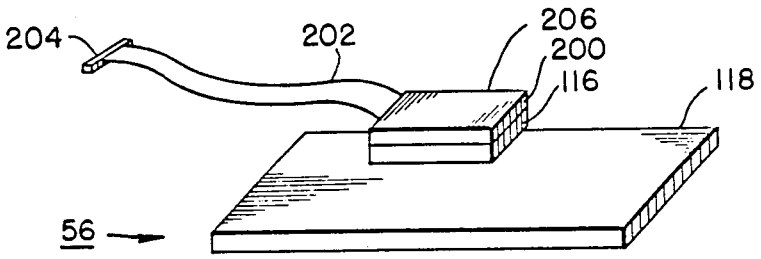
FIG. 7 is a perspective view of the Ink Jet Printer Module of FIG. 6.

Referring to FIG. 7 it can be seen that Module 56 may have the form of a compact, self-contained assembly wherein the Inkjet Drivers and Latches 116 and the Deflection Plates 118 have an Electronics Module 200 affixed thereto. The Module 200 contains, typically, the CPU 110, DEMUX 112 and Tamper Latch 114 devices (not shown in FIG. 7), which devices may be disposed upon a printed circuit board (not shown) for operatively connecting the devices one to another and to the Inkjet Latches 116. In addition, a cable 202 having a plurality of conductors is connected thereto for connecting the busses 86, 88 and 90, DMA REQ 106, and the necessary power lines (not shown in FIG. 6) by a suitable connector 204 to the Host 54.

After construction and testing, such a Module 200 is preferably filled with an epoxy based "potting" material 206 thereby embedding the devices therein within the potting material. After curing the potting material may assume a rigid or semirigid consistency suitable for protecting the devices embedded therein from environmental contaminates and, in addition, protect them from tampering.

In order to insure that the potting material 206 is not removed in order to gain access to the devices within Module 56, the invention further provides for a continuity sensor means embedded within material 206.

Referring once more to FIG. 6 the sensor means is shown to be an electrical conductor 140. Conductor 140 is connected to Latch 114 such that the logic state of one bit of data of the key stored within Latch 114 is determined by the presence or absence of conductor 140. For example, when the conductor 140 is connected a predetermined bit of the key data will be in a logical one state. Alternately, if the conductor 140 is not connected, as will occur if the conductor 140 is broken, the bit will assume a logic O state. As has been previously mentioned Vault 52 is operable for reading back the key data stored within Latch 114 to thereby check the validity of the key. If in so reading back the key data Vault 52 determines that the predetermined bit is not in the correct state, the Vault 52 may disable Host 54 from printing any further postage indicia and, in addition, set a Tamper Flag bit which will indicate to an auditing or recharging facility that the tampering has occurred. Conductor 140 is typically comprised of a length of fine wire, such as #38 gauge, which is disposed in a random manner within the potting material 206 filling Module 200. Thus, this aspect of the invention defeats an attempt to physcially gain access to the devices within Module 200 by the removal of the, typically, rigid potting material 206. if such an attempt is made, the breakage of conductor 140 is certain to occur.

As may be appreciated, if conductor 140 is broken or disconnected during an attempt to invasively tamper with Module 56, the predetermined bit of key data will assume a state which will make the key inoperative for decrypting the data to be printed. Thus CPU 110 will be disabled from providing decrypted data to the Ink Jet Drivers and Latches 116, thereby further ensuring the security of Module 56.

If the key is stored internally within CPU 110, as has been previously described, the conductor 140 may be connected directly to the CPU 110, wherein the state of the conductor 140 may be directly sensed by the CPU 110. In such case, the CPU 110 and/or conductor 140 may be embedded within the potting material 206.

Thus, it can be seen that in operation the Vault 52 would provide a first portion of the cipher key information to Module 56, while a second portion would be provided by the state of the continuity sensor means. In addition, Vault 52 would provide to Module 56 the encrypted information, or data, which is representative of the indicia to be printed. CPU 110, after receiving the encrypted information, decrypts the information in accordance with the first and second portions of the key information, the decrypted information thereafter being provided to the ink jet printer mechanism for printing.

It should be realized that although the conductor 140 has been described as being a length of wire, any suitable conducting means may be utilized which may be disposed within the potting material 206.

For example, the continuity sensor means may be comprised of an optical source, such as a light emitting diode (LED) and an optical sensor, such as a phototransistor, which are embedded in and maintained in relative optical alignment one to another by potting material 206. Optical continuity may be maintained between the LED and the phototransistor by means of a suitable open channel made within the material 206. If the material 206 were removed or disturbed, the optical alignment would be lost, and optical continuity would be broken.

Similarly, it should be noted that although this invention is described in terms of a particular method of decrypting and encrypting information, it is done for illustrative purposes only. Thus, this invention could be utilized with other methods of encryption/decryption and those teachings would still be within the spirit and scope of the invention. Similarly, it should be noted that although this invention is described in terms of a particular combination of information used in the generation of the key data, it is done for illustrative purposes only. Thus this invention could be utilized with other types and combinations of information and those teachings would still be within the spirit and scope of the invention. Similarly, it should be noted that even though microcomputers were used in the Vault 52, Host 54 and Module 56 this invention could be used with other methods of processing the information and it would still be within the spirit and scope of Applicant's invention.

Finally, it should be noted that although the invention has been described in the context of securing an Ink Jet type printer, the use of the invention may be applied to securing a variety of printer types or other types of devices altogether. For example, the invention may be utilized for securing a dot matrix impact type of printer, wherein the printhead has a plurality of solenoids which must be activated in a specific manner to print a desired pattern.

Figure 8:
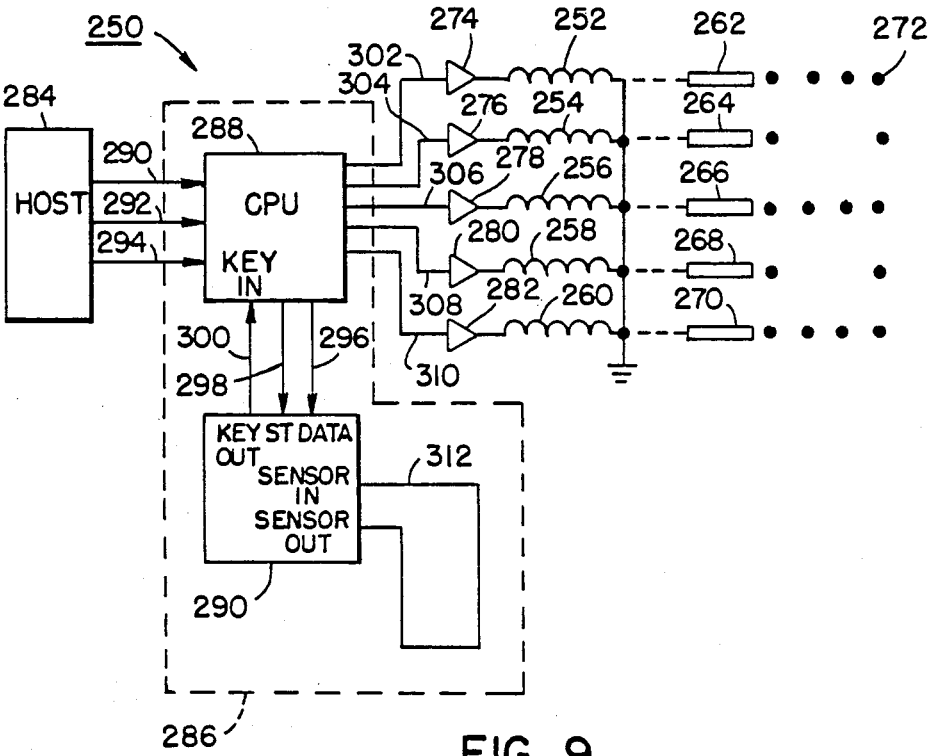
FIG. 8 is a block diagram showing an alternate embodiment of invention used in an impact type of printer.

Referring to FIG. 8 there is shown one such dot matrix impact type print head 250. Printhead 250 is comprised of a plurality of solenoids 252 through 260 each one of which, when energized, drives a respective print wire 262 through 270. Wires 262 through 270 are disposed relative to a print ribbon (not shown) such that they will strike the ribbon, causing the printing of a dot on an underlying document (not shown). Typically, printhead 250 is mounted on a carriage assembly (not shown) which is operable for being moved relative to the stationary document during the printing of a line of alphanumeric characters. By energizing solenoids 252 through 260 in a proper sequence, an alphanumeric character 272 may be printed on the document.

Solenoids 252 through 260 are energized, typically, by drivers 274 through 282, the drivers having the requisite current drive capability to energize the solenoids.

As may be appreciated, such drivers must be selectively activated at specific times in order to properly form a desired alphanumeric character. Such activation is typically performed by a host system 284, such as a computer, which provides the drivers with electronic activation signals in order to print a desired character, such signals corresponding, typically, in a one to one manner with the dots to be printed.

However, in some such systems it may be desirable to provide the signals in an encrypted manner to prevent the unauthorized or inadvertent use of the printhead, such as when, for example, the printhead is utilized to print payroll checks. In such a system the use of the invention may be advantageously employed to secure the operation of the printhead against the tampering.

As shown in FIG. 8, a Decryption Module 286 is interposed between host 284 and the drivers 274 through 282. Module 286 is comprised, in accordance with the invention, of a Decryption Microcomputer (CPU) 288 and a Tamper Latch 290. CPU 288 may be of the single chip type of CPU wherein the program memory and scratchpad RAM are contained internally and a plurality of input/output lines are provided for interfacing the CPU to external devices. In this embodiment of the invention CPU 288 communicates with host 284 via a bidirectional data bus 290, an address bus 292, and a control bus 294, although a number of different types of communication methods may be used. CPU 288 may also communicate with Latch 290 via a Local Data Bus (LDB) 296, a strobe 298, and a Key Data Bus (KDB) 300. CPU 288 is also coupled to the inputs of drivers 274 through 282 via output lines 302 through 310, whereby CPU 288 may activate each driver selectively to cause the printing of dot matrix characters.

In operation, host 284 encrypts the desired dot matrix data using a cipher key in accordance with a suitable encryption algorithm. The key and encrypted data are provided to CPU 288 via busses 290, 292 and 294. CPU 288, upon reception of the cipher key, stores the key within Latch 290 via LDB 296 and strobe 298. In order to decrypt the dot matrix data received from host 284, CPU 288 retrieves the key from Latch 290 via the KDB 300. After decrypting the data received from host 284, CPU 288 drives the lines 302 through 310 in accordance with the decrypted data in order to print the desired alphanumeric characters.

In accordance with the invention the Module 286 may be filled with a suitable potting material, thereby embedding CPU 288 and Latch 290 within. In order that the host 284 may determine if the potting material has been removed or otherwise disturbed, a continuity sensor means 312 is connected to Latch 290. Sensor means 312, which may be length of fine wire, is disposed randomly through the potting material such that any attempt at removing the potting material will cause the breakage of the wire. As was described beforehand, the sensor means 312 is operable for defining a portion of the cipher key required to enable the decryption of the data to be printed. Therefore the breakage of the sensor 312 will cause the enabling cipher key data to become disabling, thereby preventing CPU 288 from printing meaningful alphanumeric characters. In addition, host 284 may read back, via CPU 288, the cipher key within Latch 390 to determine if that portion of the cipher key defined by sensor 312 is in a correct, predetermined state. If the host 284 determines that the state is incorrect, the host may disable the printing of further characters.

As an exmaple of a non-printing application, the invention may be utilized to secure an electronic type locking mechanism, wherein the mechanism is responsive to input data to engage or disengage a mechanical bolt or lock.

Figure 9:
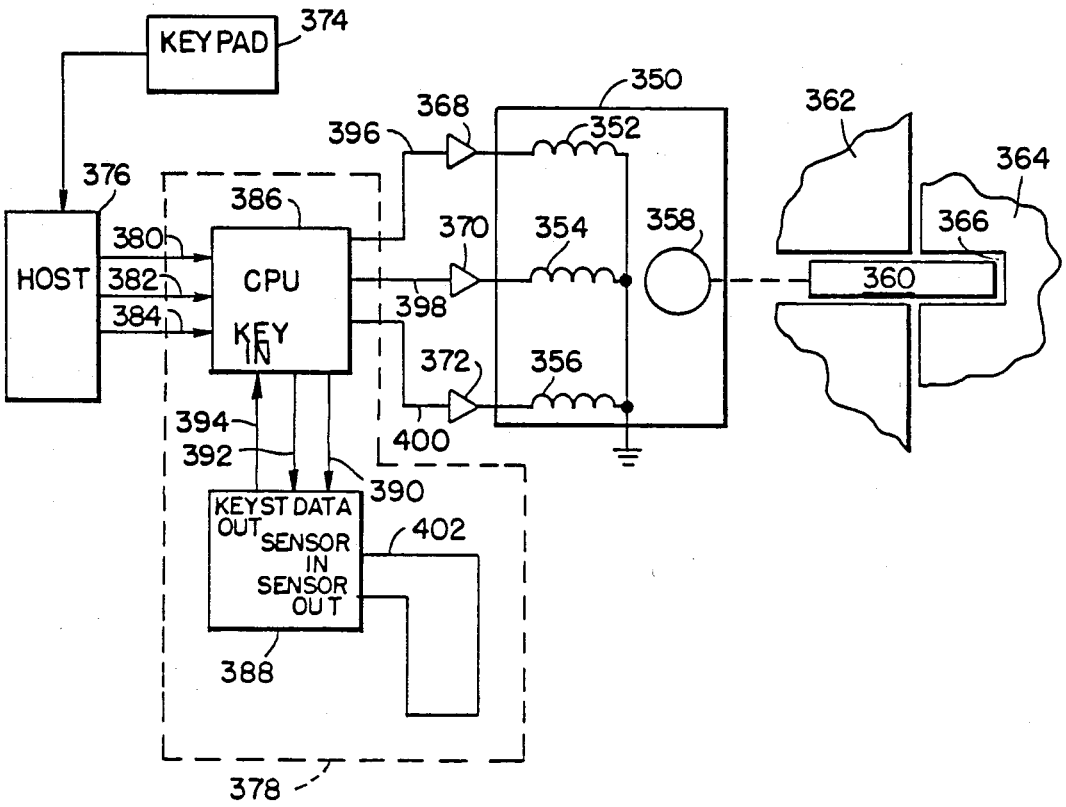
FIG. 9 is a block diagram of another embodiment of the invention used in an electrnic combination lock mechanism.

Referring now to FIG. 9 one such type of locking mechanism is shown. The mechanism may be comprised of a motor assembly 350, such as a stepper motor having a plurality of armature windings 353, 354 and 356 for causing the rotation of a rotor 358. Coupled to rotor 358 by a suitable means, such as by a worm gear (not shown) is a bolt 360 slideably disposed within a channel made within a bulkhead 362. Disposed adjacent to bolt 360 may be a door 364 having a recess 366 therein for receiving bolt 360, whereby the door is prevented from opening when the bolt 360 is inserted within. In order to energize assembly 350 suitable current drivers 368, 370 and 372 are connected to the armature windings 352, 354 and 356, respectively.

In operation the assembly 350 may be activated for inserting or withdrawing bolt 360 by an operator entering data at a remote keypad 374, which data may be a sequence of numbers or letters corresponding to a combination or some other secret number. The keypad 374 is operably coupled to a host 376, which may be a microcomputer, whereby the secret number is encrypted in accordance with a cipher key. The encrypted number and cipher key is provided to an Electronics Module 378 for decryption, whereby if the decrypted number matches one of a set of valid access code numbers stored within Module 378, the bolt 360 will be engaged or disengaged. The number would be encrypted to prevent an unauthorized monitoring of communication between host 376 and Module 378 in order to ascertain the secret number. Module 378 may be identical to the Module 286 of FIG. 8, that is, it may be comprised of a bidirectional data bus 380, an address bus 382, and a control bus 384 for communication between a decryption CPU 386 and the host 376. Additionally, the Module 378 may be comprised of a Tamper Latch 388 operable for storing the cipher key, Latch 388 being coupled to CPU 386 via a LDB 390, strobe 392, and KDB 394. CPU 386 may also have three outputs 396, 398 and 400 for causing the drivers 368, 370 and 372, respectively, to drive assembly 350.

In accordance with the invention, Module 378 may be filled with potting material in order to embed CPU 386 and Latch 388 within, thereby preventing access to these devices. To further secure these embedded devices, Latch 388 may be provided with a continuity sensor means 402 which operates, as has been described above, to define a portion of the cipher key.

Thus, it may be seen that the above described embodiment of the invention can be modified in a variety of ways and those modifications would still be within the spirit and scope of the Applicants'invention. Therefore, while this invention has been disclosed by means of specific, illustrative embodiments, the principals thereof are capable of a wide range of modification by those skilled in the art within the scope of the following claims.

What is claimed is:

1. A system for securing operation of an electrically operable device against tampering, said device adapted to be activated in response to information conveyed by an input signal for causing a desired output of said device to occur, at least a portion of said information being encrypted utilizing a cipher key, said system comprising:

means for decrypting said encrypted information to activate said device for causing said output to occur, said means for decrypting adapted to be enabled by a key signal representative of the cipher key; and continuity sensing means for defining at least a portion of said cipher key signal, said sensing means enabling said decrypting means when said sensing means defines said portion of said cipher key signal.

2. The system of claim 1 wherein said means for decrypting is a microcomputer.

3. The system of claim 1 wherein said device is a printer mechanism for printing on a document and said desired output including printing on the document.

4. The system of claim 1 further comprising:

means for storing said cipher key, said storing means electrically connected to said decrypting means for providing said decrypting means with said cipher key signal.

5. The system of claim 4 wherein said continuity sensing means includes means electrically connected to said means for storing, said continuity sensor means defining said portion of said key signal when said sensing means senses continuity thereof.

6. A secure assembly for printing indicia on a document, said assembly adapted to be resonsive to an input data signal for printing information conveyed by the input data signal, the information corresponding to the indicia to be printed, at least a portion of the information being encrypted using cipher key information, said assembly comprising:

a decrypting device for decrypting said encrypted information in accordance with cipher key information;

a storage device for storing cipher key information, said storage device electrically connected to said decrypting device for providing thereto cipher key information;

a print control device for controlling printing of said indicia;

a printing mechanism connected to said decryption device and to said control device, said mechanism printing said indicia on said document in accordance with the decrypted information when said cipher key information is provided; and continuity sensing means including a communication link and means for detecting continuity of said link, said communications link providing at least a portion of said cipher key information to said decrypting device when continuity of said link is detected by said detecting means.

7. The assembly of claim 6 wherein said decrypting device and said control device are a microcomputer.

8. The assembly of claim 6 wherein said storage device further includes said continuity sensing means and said detecting means disabling said decrypting device when continuity is not detected.

9. The assembly of claim 8 wherein said communication link is a length of electrical conductor.

10. The assembly of claim 9 wherein at least said storage device and said conductor are physically enclosed within an enclosure to prevent access to said storage device.

11. The assembly of claim 10 wherein said enclosure includes a potting material within which said storage device and said conductor are embedded.

12. The assembly of claim 11 wherein said conductor is sufficiently small in cross-sectional area that removal of said potting material breaks said conductor, whereby said detecting means detects discontinuity of said communication link for disabling said decryption device.

13. A method of securing against tampering a device of the type which is responsive to information conveyed thereto for causing the device to activate a desired output, at least a portion of the information being encrypted in accordance with valid cipher key information, comprising the steps of:

providing a first portion of the valid cipher key information to the device;

providing continuity sensing means for conveying a second portion of the valid cipher key information to the device, the continuity sensing means permitting conveyance of said second portion of the valid cipher key information when said sensing means senses continuity and interrupting conveyance of said second portion of the valid cipher key when said sensing means senses diuscontinuity;

decrypting the encrypted portion of the conveyed information, in accordance with the first and the second portions of the valid key information; and activating the desired output in accordance with the decrypted information.

14. The method of claim 13 wherein the device is comprised of a processing means including means for decrypting the information.

15. The method of claim 15 wherein the step of providing a first portion of the valid key information further comprises a step of storing the first portion within a storage means electrically connected to processing means for providing the processing means with the first portion.

16. The method of claim 15 including the step of electrically connected the continuity sensor means to the storage means for providing the processing means with the second portion of the valid key information.

17. The method of claim 16 including the step of embedding at least the storage means and the continuity sensor means within a potting material to prevent access to the storage means.

18. The method of claim 17 wherein the step of providing continuity sensing means includes providing a length of electrical conductor of sufficiently small cross-sectional area to permit breaking thereof when removing the potting material whereby the second portion of the valid key information is not provided and the step of activating the desired output is thereby inhibited from occurring.

19. A value printing system including a secured printer assembly for the printing of indicia including a value, said system comprising a metering device including means for accounting for the value to be printed, said metering device including means for generating encrypted data in accordance with a cipher key, the encrypted data representative of the indicia to be printed, said metering device including means for providing the encrypted data and the cipher key to said printer assembly, said assembly comprising:

decrypting means for decrypting the data in accordance with the cipher key;

storage means for storing the cipher key, said storage means connected electrically to said decrypting means for providing the cipher key thereto; and continuity sensing means electrically connected to said storage means, said sensing means including conducting means, said sensing means including means for detecting continuity of said conducting means, said conducting means defining at least a portion of the cipher key for said storage means when continuity is sensed, and said conducting means not defining said portion of said cipher key for said storage means when continuity is not sensed. a printing mechanism operably coupled to said decryption device for printing the decrypted data whereby said indicia is printed.

20. The printer assembly of claim 19 wherein said printing mechanism is an ink jet printer mechanism.

21. The printing assembly of claim 19 wherein said decryption means is a microcomputer.

22. The printer assembly of claim 21 wherein said conducting means is comprised of a length of electrical conductor.

23. The printer assembly of claim 22 including an enclosure, and wherein at least said storage means and said conductor are enclosed within said enclosure to prevent physical access to said storage means.

24. The printer assembly of claim 23 wherein said enclosure includes a potting material embedding said storage means and said conductor therewithin to further prevent access to said storage means.

25. The printer assembly of claim 24 wherein said conductor is of sufficiently small cross-sectional area that removal of said potting material breaks said conductor thereby causing said conductor to be disabled from defining said portion of said cipher key.

26. A system for securing a device against invasive tampering, said device adapted to be responsive to encrypted input data for providing a desired output, said system comprising:

decryption microcomputer means for providing decrypted data from said encrypted input data only when said microcomputer means is provided with a valid cipher key, said microcomputer means including means for providing said desired output in accordance with said decrypted data;

storage means for storing a first portion of said valid cipher key, said storage means electrically connected to said microcomputer means for providing said first portion thereto;

continuity sensor means electrically connected to said microcomputer means for providing a second portion of said valid cipher key thereto, said sensor means including conducting means and means for detecting continuity of said conducting means, said conducting means providing said second valid portion only when said detecting means detects continuity of said conducting means; and potting material means embedding at least said conducting means therewithin, said conducting means positioned within said potting material means such that invasive tampering with said potting material means results in said detecting means not sensing continuity of said conducting means whereby said decryption microcomputer means is not provided with said second portion of said valid cipher key thereby preventing the occurrence of said desired output.

* * * * *